US008394565B2

(12) United States Patent
Sensui

(10) Patent No.: US 8,394,565 B2
(45) Date of Patent: Mar. 12, 2013

(54) POSITIVELY CHARGED DEVELOPER FOR DEVELOPMENT OF ELECTROSTATIC IMAGE AND PRODUCTION PROCESS THEREOF

(75) Inventor: Keita Sensui, Tokyo (JP)

(73) Assignee: Zeon Corporation, Tokyo (JP)

( * ) Notice: Subject to any disclaimer, the term of this patent is extended or adjusted under 35 U.S.C. 154(b) by 880 days.

(21) Appl. No.: 12/294,808

(22) PCT Filed: Mar. 30, 2007

(86) PCT No.: PCT/JP2007/057698

§ 371 (c)(1),
(2), (4) Date: Sep. 26, 2008

(87) PCT Pub. No.: WO2007/114502

PCT Pub. Date: Oct. 11, 2007

(65) Prior Publication Data

US 2010/0173240 A1 Jul. 8, 2010

(30) Foreign Application Priority Data

Mar. 30, 2006 (JP) ..... 2006-093454

(51) Int. Cl.
*G03G 9/08* (2006.01)
*G03G 9/135* (2006.01)

(52) U.S. Cl. ..... 430/108.2; 430/110.2

(58) Field of Classification Search ..... 430/108.2, 430/110.2

See application file for complete search history.

(56) References Cited

U.S. PATENT DOCUMENTS

| | | | | |
|---|---|---|---|---|
| 656,253 | A | 8/1900 | Kunstner | |
| 5,334,480 | A | 8/1994 | Inaba et al. | |
| 5,998,080 | A * | 12/1999 | Ohno et al. | 430/45.54 |
| 6,454,858 | B1 | 9/2002 | Oki et al. | |
| 6,562,536 | B2 | 5/2003 | Fujii et al. | |
| 6,733,944 | B2 | 5/2004 | Kadokura et al. | |
| 6,920,299 | B2 * | 7/2005 | Shimura et al. | 399/121 |
| 7,163,773 | B2 * | 1/2007 | Sugiura et al. | 430/109.4 |
| 7,318,989 | B2 | 1/2008 | Kotsugai et al. | |
| 7,566,521 | B2 | 7/2009 | Kotsugai et al. | |
| 2003/0027070 | A1 * | 2/2003 | Niwa | 430/108.22 |
| 2003/0039913 | A1 | 2/2003 | Kadokura et al. | |
| 2004/0067189 | A1 * | 4/2004 | Sugiura et al. | 423/335 |
| 2005/0277047 | A1 | 12/2005 | Tsuji | |
| 2007/0031748 | A1 | 2/2007 | Kotsugai et al. | |

FOREIGN PATENT DOCUMENTS

| | | | |
|---|---|---|---|
| JP | 3-175456 | A | 7/1991 |
| JP | 04-198940 | A | 7/1992 |
| JP | 06-332229 | A | 12/1994 |
| JP | 07-005726 | A | 1/1995 |
| JP | 9-106093 | A | 4/1997 |
| JP | 11-015192 | A | 1/1999 |
| JP | 2000-089507 | A | 3/2000 |
| JP | 2000-354813 | A | 12/2000 |
| JP | 2000347445 | A | 12/2000 |
| JP | 2003-057983 | A | 2/2003 |
| JP | 2004-240171 | A | 8/2004 |
| JP | 2004-286801 | A | 10/2004 |
| JP | 2004-354813 | A | 12/2004 |
| JP | 2005-202133 | A | 7/2005 |
| JP | 2005-250456 | A | 9/2005 |
| JP | 2005-215298 | A | 11/2005 |
| JP | 2005-345975 | A | 12/2005 |
| JP | 2006-18251 | A | 1/2006 |

OTHER PUBLICATIONS

Machine translation of JP 2005-215298 A.*
Machine translation of JP 2000-089507 A.*
International Search Report of PCT/JP2007/057698, date of mailing May 1, 2007.
Written Opinion of the International Searching Authority, issued to the International Application No. PCT/JP2007/057698 dated Oct. 20, 2008.
Japanese Office Action dated Mar. 13, 2012, issued in corresponding application 2008-508725.
Third party submission Notification dated Oct. 18, 2011, issued in corresponding application No. 2008-508725.
Decision to Grant Patent dated Aug. 14, 2012, issued in corresponding Japanese Patent Application No. 2008-508725 (3 pages).

* cited by examiner

*Primary Examiner* — Jonathan Jelsma
(74) *Attorney, Agent, or Firm* — Westerman, Hattori, Daniels & Adrian, LLP

(57) ABSTRACT

A positively charged developer for development of electrostatic images, comprising positively charged toner particles and an external additive, wherein the positively charged toner particles are colored resin particles composed of aggregated and fusion-bonded particles of fine binder resin particles and fine colorant particles and having a shape factor SF-1 of 115 to 150 and a shape factor SF-2 of 110 to 140, and the external additive is an external additive containing positively charged inorganic particles subjected to a hydrophobization treatment with an amino group-containing compound, and a production process thereof.

7 Claims, No Drawings

POSITIVELY CHARGED DEVELOPER FOR DEVELOPMENT OF ELECTROSTATIC IMAGE AND PRODUCTION PROCESS THEREOF

TECHNICAL FIELD

The present invention relates a positively charged developer for development of electrostatic images, which is used for development of electrostatic latent images on a photosensitive member in an image forming apparatus of an electrophotographic system, such as a copying machine, facsimile or printer, and a production process thereof.

BACKGROUND ART

In order to form an image in an image forming apparatus of the electrophotographic system, an electrostatic latent image is first formed on a photosensitive member. The electrostatic latent image is then developed with a developer (toner) on a developing roll to form a toner image. This toner image on the photosensitive member is transferred to any of various recording material such as paper and OHP sheets as needed. The toner image transferred is fixed thereto by a system of heating, pressing, solvent vapor or the like, whereby a printed image is formed. The toner remaining on the photosensitive member without being transferred to the recording material upon the transfer is recovered by a cleaning step. As a cleaning method, a method, in which a cleaning blade is brought into contact with the surface of the photosensitive member to remove the remaining toner, is widely used in that the device is simple.

In recent years, image forming apparatus of the electrophotographic system have been spread over offices, and a proportion of full-color image forming apparatus to monochromatic image forming apparatus has been recently increased. With the trend to full-color image forming apparatus, high-quality toners having various properties such as better image reproducibility, durability upon printing and environmental stability are required for toners (generally 4 color toners of cyan, magenta, yellow and black) used in development.

From the viewpoint of image reproducibility among the properties required, it is effective that toner particles are formed as particles having a spherical form, a small particle diameter and a narrow particle diameter distribution. As a process for producing such toner particles, there have been polymerization processes such as a suspension polymerization process, in which a polymerizable monomer composition containing a polymerizable monomer, a colorant and various additives is formed into droplets in an aqueous medium and then polymerized to form colored polymer particles; and an emulsion polymerization aggregation process, in which a polymerizable monomer emulsified is polymerized to synthesize fine binder resin particles, and the fine binder resin particles are then aggregated together with fine colorant particles to produce toner particles.

However, the toner particles having a spherical form and a small particle diameter have involved a problem that when the cleaning method making use of a cleaning blade is applied to the toner particles, cleaning failure is easy to occur. As a method for improving the cleaning ability of the resulting toner particles, a method for controlling the shape of toner particles has heretofore been investigated.

On the other hand, inorganic photosensitive members of selenium type, silicon type, etc. have been mainly used as photosensitive members, but organic photosensitive members are mainly used at present. The polarity of a photosensitive member charged includes a positively charged system and a negatively charged system, and the negatively charged system is general for the organic photosensitive member. However, the negatively charged system is indicated as involving a problem of ozone generation. Thus, an organic photosensitive member of the positively charged system, which is little in ozone generation, has come to be put to practical use for environmental measure.

Under the foregoing circumstances, there is a demand for development of a high-quality positively charged developer for development of electrostatic images, which meets the requirements attending on the trend to full-color image forming apparatus and can correspond to the positively charged system.

Japanese Patent Application Laid-Open No. 2005-345975 has proposed a positively charged toner containing a resin, a parting agent and colorant particles, wherein the concentration of a cationic surfactant on the surfaces of toner particles is higher than in the central portions of the toner particles. The cationic surfactant is an alkyl group-containing quaternary ammonium salt, and the toner particles are formed by the emulsion polymerization aggregation process. This publication describes that a negatively charged external additive is used as an external additive.

Japanese Patent Application Laid-Open No. 2006-18251 (corresponding to US 2005/0277047 A1) has proposed a positively charged developer for development of electrostatic images, which contains a copolymer comprising an acrylamide having an amine or ammonium salt in its molecule in surface portions (outer layers) of toner particles. This publication describes that a negatively charged external additive is preferred as an external additive.

However, these toners are not sufficient in environmental stability and insufficient in environmental stability in a high-temperature and high-humidity environment in particular, and so more improvement has been desired.

DISCLOSURE OF THE INVENTION

It is an object of the present invention to provide a positively charged developer for development of electrostatic images, by which good cleaning ability is retained, and printing properties are not impaired even when printing is conducted on a large number of sheets.

In particular, it is an object of the present invention to provide a positively charged developer for development of electrostatic images, which is hard to cause fog even upon printing under a high-temperature and high-humidity environment and exhibits excellent environmental stability in addition to the good cleaning ability.

The present inventors have carried out an extensive investigation with a view toward achieving the above-described objects. As a result, it has been found that a positively charged developer for development of electrostatic images, which is excellent in the above-described various properties, is obtained by adding positively charged inorganic particles surface-treated with a specific hydrophobizating agent as an external additive to positively charged toner particles obtained by a process (the so-called emulsion polymerization aggregation process), in which fine binder resin particles and fine colorant particles emulsified and dispersed in an aqueous medium are aggregated and fusion-bonded, and having a form somewhat distorted compared with a spherical form and having irregularities at the surface thereof, and the present invention has been completed on the basis of this finding.

According to the present invention, there is thus provided a positively charged developer for development of electrostatic images, comprising positively charged toner particles and an external additive, wherein (a) the positively charged toner particles are colored resin particles composed of aggregated and fusion-bonded particles of fine binder resin particles and fine colorant particles and having a shape factor SF-1 of 115 to 150 and a shape factor SF-2 of 110 to 140, and (b) the external additive is an external additive containing positively charged inorganic particles subjected to a hydrophobization treatment with an amino group-containing compound.

According to the present invention, there is also provided a process for producing a positively charged developer for development of electrostatic images, which comprises positively charged toner particles and an external additive, the process comprising:

(1) Step 1 of producing the positively charged toner particles composed of colored resin particles having a shape factor SF-1 of 115 to 150 and a shape factor SF-2 of 110 to 140, including a step of aggregating and fusion-bonding fine binder resin particles and fine colorant particles emulsified and dispersed in an aqueous medium; and (2) Step 2 of externally adding positively charged inorganic particles subjected to a hydrophobization treatment with an amino group-containing compound to the colored resin particles.

In the present invention, the positively charged toner particles may preferably contain a charge control agent. The charge control agent may more preferably be a charge control resin having positively charging ability.

In the present invention, the charge control resin having positively charging ability may preferably be a polymer comprising a quaternary ammonium salt-containing acrylate unit represented by the following structural formula (1):

(1)

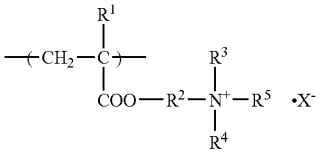

wherein $R^1$ is a hydrogen atom or a methyl group, $R^2$ is an alkylene group, $R^3$, $R^4$ and $R^5$ are, independently of one another, a hydrogen atom, a linear or branched alkyl group having 1 to 6 carbon atoms, or a cyclic alkyl group, and $X^-$ is a halogen ion, a benzenesulfonic ion or an alkylbenzenesulfonic ion.

In the present invention, the external additive may preferably be an external additive containing (1) positively charged inorganic particles subjected to a hydrophobization treatment with an amino group-containing compound and having a small particle diameter of 5 to 25 nm in terms of a number average primary particle diameter or (2) a positively charged inorganic particles subjected to a hydrophobization treatment with an amino group-containing compound and having a small particle diameter of 5 to 25 nm in terms of a number average primary particle diameter and positively charged inorganic particles subjected to a hydrophobization treatment with an amino group-containing compound and having a large particle diameter of 30 to 300 nm in terms of a number average primary particle diameter.

The external additive may preferably be an external additive containing conductive fine particles subjected to a hydrophobization treatment with an amino group-containing compound and having an number average particle diameter of 30 to 300 nm in addition to the positively charged inorganic particles subjected to the hydrophobization treatment with the amino group-containing compound.

In the present invention, the positively charged toner particles may preferably have a core-shell structure. The toner particles of the core-shell structure may preferably be toner particles obtained by aggregating and fusion-bonding fine charge control resin particles having positively charging ability on the surfaces of core particles obtained by aggregating and fusion-bonding fine binder resin particles and fine colorant particles emulsified and dispersed in an aqueous medium to form a shell layer on each core particle.

BEST MODE FOR CARRYING OUT THE INVENTION

The positively charged developer for development of electrostatic images according to the present invention and the production process thereof will hereinafter be described in detail. Hereinafter, the positively charged developer for development of electrostatic images may be referred to as "positively charged toner" merely.

The positively charged toner according to the present invention contains positively charged toner particles and an external additive. The positively charged toner particles are particles containing a binder resin and a colorant, and preferably particles further containing a charge control agent and a parting agent. The positively charged toner particles may contain other additives such as a pigment dispersant.

The positively charged toner particles are colored resin particles formed by a process including a step of aggregating and fusion-bonding fine binder resin particles and fine colorant particles emulsified and dispersed in an aqueous medium. The positively charged toner particles have a shape factor SF-1 of 115 to 150 and a shape factor SF-2 of 110 to 140. The external additive includes positively charged inorganic particles subjected to a hydrophobization treatment with an amino group-containing compound.

(1) Binder Resin

As specific examples of the binder resin, may be mentioned resins heretofore widely used in toners, such as polyester, polystyrene, styrene-acrylic ester copolymers, polyester resins and epoxy resins.

(2) Colorant

As the colorant, may be used various pigments and dyes used in the field of toners. When color toners are produced, respective colorants of cyan, yellow and magenta in addition to black and white may be used.

As the black colorant, may be used dyes and pigments such as carbon black, titanium black, nigrosine-based dyes and pigments, and magnetic powders such as cobalt, nickel, magnetite, triiron tetroxide, manganese iron oxide, zinc iron oxide and nickel iron oxide.

As the white colorant, may be used titanium white and the like.

As the cyan colorant, may be used copper phthalocyanine compounds and derivatives thereof, anthraquinone compounds, and the like. Examples thereof include C.I. Pigment Blue: 2, 3, 15, 15:1, 15:2, 15:3, 15:4, 16, 17:1 and 60.

As the yellow colorant, may be used compounds, such as azo pigments such as mono-azo pigments and dis-azo pigments, and fused polycyclic pigments. Examples thereof include C.I. Pigment Yellow: 3, 12, 13, 14, 15, 17, 62, 65, 73, 74, 83, 93, 97, 120, 138, 155, 180, 181, 185 and 186.

As the magenta colorant, may be used compounds, such as azo pigments such as mono-azo pigments and dis-azo pigments, and fused polycyclic pigments. Specific examples thereof include C.I. Pigment Red: 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19.

The amount of the colorant used is generally 1 to 50 parts by weight, preferably 1 to 20 parts by weight per 100 parts by weight of the binder resin.

(3) Charge Control Agent

The positively charged toner according to the present invention preferably contains a charge control agent. As the charge control agent, only a charge control agent having positively charging ability may be used for providing a positively charged toner. Alternatively, the charge control agent having positively charging ability is used as a main component, and a charge control agent having negatively charging ability may also be used in combination in such a small amount that the resulting toner is positively charged.

Example of the charge control agent having positively charging ability include nigrosine dyes, quaternary ammonium salts, triaminotriphenylmethane compounds, imidazole compounds; and charge control resins such as polyamine resins, and amino group- or quaternary ammonium group-containing copolymers. In the present invention, the charge control resin having positively charging ability is preferably used.

Examples of the charge control resin having positively charging ability include resins containing an amino group such as $—NH_2$, $—NHCH_3$, $—N(CH_3)_2$, $—NHC_2H_5$, $—N(C_2H_5)_2$ or $—NHC_2H_4OH$; and quaternary ammonium salt-containing resins obtained by converting such an amino group to an ammonium salt. Among these resins, the quaternary ammonium salt-containing resins are preferred.

Such a charge control resin exhibiting the positively charging ability is obtained by, for example, copolymerizing a monovinyl monomer containing an amino group with a monovinyl monomer copolymerizable with such a monomer. The charge control resin having positively charging ability may also be obtained by converting an amino group-containing copolymer to an ammonium salt. The quaternary ammonium salt-containing resin may also be obtained by copolymerizing a monovinyl monomer containing an ammonium salt group with a monovinyl monomer copolymerizable with such a monomer. However, the production processes of the charge control resin having positively charging ability are not limited to these processes.

Among the quaternary ammonium salt group-containing resins, a quaternary ammonium salt-containing acrylate represented by the following structural formula (1) and a quaternary ammonium salt-containing acrylamide represented by the following structural formula (2) are preferred as the charge control resins having positively charging ability.

(1)

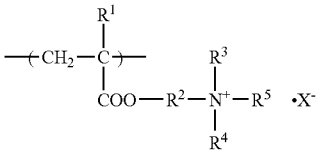

-continued (2)

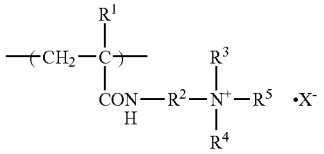

In the structural formulae (1) and (2), $R^1$ is a hydrogen atom or a methyl group, $R^2$ is an alkylene group, $R^3$, $R^4$ and $R^5$ are, independently of one another, a hydrogen atom, a linear or branched alkyl group having 1 to 6 carbon atoms, or a cyclic alkyl group, and $X^-$ is a halogen ion, a benzenesulfonic ion or an alkylbenzenesulfonic ion.

In the quaternary ammonium salt shown in the structural formula (1), $X^-$ is preferably a chloride ion or a toluenesulfonic ion, $R^1$ is preferably a hydrogen atom or a methyl group, $R^2$ is preferably an alkylene group having 1 to 3 carbon atoms, such as $CH_2$, $C_2H_4$ or $C_3H_6$, and $R^3$ to $R^5$ are, independently of one another, preferably an alkyl group such as $CH_3$, $C_2H_5$ or $C_3H_7$.

Processes for preparing the polymer comprising the quaternary ammonium salt-containing acrylate unit represented by the structural formula (1) include the following processed (a) to (d):

(a) A process, in which a monomer (hereinafter referred to as "vinyl aromatic hydrocarbon monomer") giving an aromatic hydrocarbon unit having a vinyl group, a monomer giving an acrylate or methacrylate unit (hereinafter referred to "acrylate or methacrylate" as "(meth)acrylate"), and an N,N-di-substituted aminoalkyl (meth)acrylate (hereinafter referred to as "amino group-containing (meth)acrylate monomer") are copolymerized in the presence of a polymerization initiator, and the amino group is then converted to an ammonium salt with an ammonium salt-forming agent;

(b) A process, in which a vinyl aromatic hydrocarbon monomer, a monomer giving a (meth)acrylate unit, and an amino group-containing (meth)acrylate monomer (hereinafter referred to as "halogenated quaternary ammonium salt group-containing (meth)acrylate monomer") obtained by converting an amino group-containing (meth)acrylate monomer to an ammonium salt with a halogenated organic compound are copolymerized in the presence of a polymerization initiator, and the resultant reaction product is then reacted with an organic acid to form a salt (the process described in Japanese Patent Application Laid-Open No. 3-175456, or a process corresponding to this process);

(c) A process, in which a vinyl aromatic hydrocarbon monomer, a monomer giving a (meth)acrylate unit, and a quaternary ammonium salt group-containing (meth)acrylate monomer are copolymerized in the presence of a polymerization initiator to obtain the polymer directory; and (d) A process, in which a copolymer of a vinyl aromatic hydrocarbon monomer and a halogenated alkyl (meth)acrylate is mixed with a copolymer of a vinyl aromatic hydrocarbon monomer and an amino group-containing (meth)acrylate monomer to form an ammonium salt between the polymers.

Examples of the amino group-containing (meth)acrylate monomer include N,N-di-substituted aminoalkyl (meth) acrylate compound such as dimethylaminomethyl (meth) acrylate, diethylaminomethyl (meth)acrylate, dipropylaminomethyl (meth)acrylate, diisopropylaminomethyl (meth) acrylate, ethylmethylaminomethyl (meth)acrylate, methylpropylaminomethyl (meth)acrylate, dimethylamino-1-ethyl (meth)acrylate, diethylamino-1-ethyl (meth)acrylate, dipropylamino-1-ethyl (meth)acrylate, diisopropylamino-1-ethyl (meth)acrylate, ethylmethylamino-1-ethyl (meth)acrylate, methylpropylamino-1-ethyl (meth)acrylate, dimethylamino-2-ethyl (meth)acrylate, diethylamino-2-ethyl (meth) acrylate, dipropylamino-2-ethyl (meth)acrylate, diisopropylamino-2-ethyl (meth)acrylate, ethylmethylamino-2-ethyl (meth)acrylate, methylpropylamino-2-ethyl (meth)acrylate, dimethylamino-1-propyl (meth)acrylate, diethylamino-1-propyl (meth)acrylate, dipropylamino-1-propyl (meth)acrylate, diisopropylamino-1-propyl (meth) acrylate, ethylmethylamino-1-propyl (meth)acrylate, methylpropylamino-1-propyl (meth)acrylate, dimethylamino-2-propyl (meth)acrylate, diethylamino-2-propyl (meth) acrylate, dipropylamino-2-propyl (meth)acrylate, diisopropylamino-2-propyl (meth)acrylate, ethylmethylamino-2-propyl (meth)acrylate and methylpropylamino-2-propyl (meth)acrylate.

Examples of a quaternizing agent used for converting the copolymer to an ammonium salt include alkyl halides such as methyl iodide, ethyl iodide, methyl bromide and ethyl bromide; and alkyl p-tolulenesulfonates such as methyl p-tolulenesulfonate, ethyl p-tolulenesulfonate and propyl p-tolulenesulfonate.

The amount of the monomer unit having a functional group such as an amino group or ammonium salt group is preferably 0.5 to 15% by weight, more preferably 1 to 12% by weight, particularly preferably 2 to 20% by weight based on the charge control resin. If the amount of the monomer unit having this functional group is too small, such a charge control resin is required to be used in a large amount for achieving a necessary charge level, so that the resulting toner is liable to lower environmental stability. If the amount of the monomer unit having this functional group is too large, lowering of the charge level of the resulting toner under a high-temperature and high-humidity environment becomes great, so that fog may occur in some cases.

The weight average molecular weight of the charge control resin is preferably 2,000 to 30,000, more preferably 4,000 to 25,000, particularly preferably 6,000 to 20,000.

The glass transition temperature of the charge control resin is preferably 40 to 100° C., more preferably 45 to 80° C., particularly preferably 45 to 75° C.

If the weight-average molecular weight and glass transition temperature of the charge control resin are too low, the shelf stability of the resulting toner may be deteriorated in some cases. If the weight-average molecular weight and glass transition temperature are too high, the fixing ability of the resulting toner may be deteriorated in some cases.

The amount of the charge control resin used is preferably 0.01 to 20 parts by weight, more preferably 0.3 to 10 parts by weight of the binder resin.

(4) Parting Agent

A parting agent is preferably contained in the positively charged toner according to the present invention because the parting ability of the toner from a fixing roll upon fixing is improved.

Examples of the parting agent include low molecular weight polyolefin waxes, and modified waxes thereof; plant waxes such as jojoba; petroleum waxes such as paraffin; mineral waxes such as ozokerite; synthetic waxes such as Fischer-Tropsch wax; and polyhydric alcohol esters such as pentaerythritol esters and dipentaerythritol esters. Among these, polyhydric alcohol esters are preferred from the viewpoint of improving a balance between the shelf stability and low-temperature fixing ability of the resulting toner. These parting agents may be used either singly or in any combination thereof.

The parting agent is used in a proportion of preferably 2 to 40 parts by weight, more preferably 5 to 30 parts by weight per 100 parts by weight of the binder resin.

(5) Production Process of Positively Charged Toner Particles

In the present invention, the so-called emulsion polymerization aggregation process is adopted as a process for producing toner particles composed of colored resin particles.

In the emulsion polymerization aggregation process, a dispersion of fine binder resin particles with respective particles emulsified and dispersed in an aqueous medium is mixed with a dispersion of fine colorant particles and optionally with a dispersion of fine charge control agent particles and a dispersion of fine parting agent particles to cause aggregation and fusion bonding, thereby obtaining toner particles composed of colored resin particles. The dispersion of the toner particles thus obtained is washed, dehydrated and dried, whereby dried toner particles can be obtained.

In order to conduct the aggregation and fusion bonding, it is preferable to heat the dispersion to a temperature not lower than the glass transition point of the binder resin. After the aggregation is stopped, the shape of the resulting toner particles can be controlled by continuing the heating. From the viewpoint of shape control, the heating temperature upon the shape control is controlled within a range of from a temperature not lower than the glass transition temperature of the binder resin to a temperature not higher than 95° C., and the heating time is controlled within a range of from 1 to 10 hours, preferably from 2 to 8 hours.

The fine binder resin particles can be generally obtained as a dispersion of the fine binder resin particles by subjecting the polymerizable monomer, and optionally a crosslinkable monomer and a molecular weight modifier to emulsion polymerization in an aqueous medium containing an ionic surfactant. Upon the emulsion polymerization, a parting agent and a charge control agent are dissolved in the polymerizable monomer, and the polymerization is then conducted, whereby these components can also be contained in the fine binder resin particles.

In the present invention, the fine binder resin particles are preferably obtained by emulsion polymerization by a multi-stage polymerization process. In the multi-stage polymerization process, a polymerizable monomer is first emulsion-polymerized as the first stage, thereby forming polymer particles as core. Another polymerizable monomer is then added in the presence of the polymer particles as core to conduct the second-stage polymerization, whereby another polymer can be formed outside the polymer as core.

As another process for obtaining the fine binder resin particles, if a binder resin is soluble in a solvent low in solubility in water, such a resin is dissolved in the organic solvent, and then dispersed as fine particles in water together with an ionic surfactant and a polymeric electrolyte in a device capable of applying high shear, such as a rotation shearing type homogenizer. Thereafter, the solvent is distilled off by heating or pressure reduction, whereby a dispersion of the fine binder resin particles can be prepared.

The dispersion of fine colorant particles, the dispersion of fine charge control agent particles and the dispersion of fine parting agent particles can be obtained by respectively dispersing a colorant, a charge control agent and a parting agent in an aqueous medium containing a surfactant by means of a device capable of applying high shear, such as a rotation shearing type homogenizer such as CLEARMIX (trade name, manufactured by M TECHNIQUE CO., LTD.) or MILDER (trade name, manufactured by Ebara Corporation); or a media type dispersing machine such as ATTRITOR (trade name, manufactured by Mitsui Miike Engineering Corporation), MIGHTY MILL (trade name, manufactured by INOUE MFG., INC.), DIAMOND FINE MILL (trade name, manufactured by Mitsubishi Heavy Industries, Ltd.,) or DYNO MILL (trade name, manufactured by Shinmaru Enterprises Corporation).

(Polymerizable Monomer)

In the present invention, the polymerizable monomer means a polymerizable compound.

A monovinyl monomer is used as a main component of the polymerizable monomer. Examples of the monovinyl monomer include vinyl aromatic hydrocarbon monomers such as styrene, and styrene derivatives such as vinyltoluene and α-methylstyrene; acrylic acid and methacrylic acid; acrylates such as methyl acrylate, ethyl acrylate, propyl acrylate, butyl acrylate, 2-ethylhexyl acrylate and dimethylaminoethyl acrylate; methacrylates such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; olefins such as ethylene, propylene and butylene; vinyl halides and vinylidene halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Among these monovinyl monomers, styrene, styrene derivatives, derivatives of acrylic acid or methacrylic acid are preferably used.

The monovinyl monomer is preferably selected in such a manner that the glass transition temperature (hereinafter referred to as Tg) of a polymer obtained by polymerizing it is 80° C. or lower. The monovinyl monomers are used singly or in combination of 2 or more thereof, whereby the Tg of the polymer formed can be controlled within a desired range.

In order to improve the hot offset resistance of the resulting toner, any crosslinkable monomer may be used together with the monovinyl monomer. The crosslinkable monomer means a monomer having at least two polymerizable functional groups. As examples of the crosslinkable monomer, may be mentioned aromatic divinyl compounds such as divinylbenzene, divinylnaphthalene and derivatives thereof; ester compounds with 2 or more carboxylic acids bonded to an alcohol having 2 or more hydroxyl groups by ester linkage, such as ethylene glycol dimethacrylate and diethylene glycol dimethacrylate; other divinyl compounds such as N,N-divinylaniline and divinyl ether; and compounds having 3 or more vinyl groups.

A macromonomer may also be used as a part of the polymerizable monomer. It is preferable to use the macromonomer because a balance between the shelf stability and low-temperature fixing ability of the resulting toner can be improved. The macromonomer is a reactive oligomer or polymer having a polymerizable carbon-carbon unsaturated double bond at its molecular chain terminal and a number average molecular weight of 1,000 to 30,000.

(6) Polymerization Initiator

As examples of the polymerization initiator, may be mentioned persulfates such as potassium persulfate and ammonium persulfate; azo compounds such as 4,4'-azobis(4-cyanovaleric acid), 2,2'-azobis[2-methyl-N-(2-hydroxyethyl) propionamide], 2,2'-azobis(2-amidinopropane) dihydrochloride, 2,2'-azobis(2,4-dimethylvaleronitrile) and 2,2'-azobisisobutyronitrile; and peroxides such as di-t-butyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate and t-butyl peroxyisobutyrate.

The amount of the polymerization initiator added is preferably 0.1 to 20 parts by weight, more preferably 0.3 to 15 parts by weight, particularly preferably 1 to 10 parts by weight per 100 parts by weight of the monomer (including a monomer composition containing 2 or more monomers).

(7) Molecular Weight Modifier

In the present invention, a molecular weight modifier is preferably used upon the polymerization. Examples of the molecular weight modifier include mercaptans such as t-dodecylmercaptan, n-dodecylmercaptan, n-octylmercaptan and 2,2,4,6,6-pentamethylheptane-4-thiol. The molecular weight modifier may be added before the initiation of the polymerization or in the course of the polymerization. The amount of the molecular weight modifier added is preferably 0.01 to 10 parts by weight, more preferably 0.1 to 5 parts by weight per 100 parts by weight of the monomer.

(8) Surfactant

In the production process of the toner according to the present invention, a surfactant is used for the purpose of emulsion-polymerizing fine binder resin particles, dispersing the colorant and the parting agent, aggregating these components or stabilizing the resultant aggregates. Examples of the surfactant includes anionic surfactants of the sulfate salt type, sulfonate salt type, phosphate type and soap type; cationic surfactants of the amine salt type and quaternary ammonium salt type; and nonionic surfactants of the polyethylene glycol type, alkylphenol ethylene oxide adduct type and polyhydric alcohol type.

(9) Toner Particles

The colored resin particles obtained above may be used as a toner by adding an external additive thereto, but are preferably used as toner particles having a core-shell structure by using the colored resin particles as core particles and forming a shell different from the core on each surface of the core particles. In the toner particles having the core-shell structure, a core formed of a low-softening point substance is covered with a substance having a higher softening point than this core substance, whereby a balance between lowering of a fixing temperature and prevention of aggregation upon storage can be adjusted.

Processes for forming the shell layer include a process, in which a monomer for shell is polymerized on core particles by an in-situ polymerization process to form a polymer making up a shell layer; and a process, in which a dispersion with resin particles for shell emulsified and dispersed is added into an aqueous medium to form a shell layer by aggregation and fusion bonding.

In the present invention, the shell layer is preferably formed by a process in which a polymer comprising a charge control resin having positively charging ability as a main component is aggregated and fusion-bonded, and the shell layer is more preferably formed by using only the charge control resin having positively charging ability from the viewpoint of durability of the resulting toner upon printing.

The toner particles are preferably washed by using a method that filtration and re-slurrying with ion-exchanged water are conducted repeatedly several times; or a method that ion-exchanged water is supplied while conducting dehydration by a dryer, thereby reducing a surfactant and inorganic ions remaining in the toner.

No particular limitation is imposed on methods for dehydration and filtration, and various publicly known methods may be used. However, as examples of the methods, may be mentioned a centrifugal filtration method, a vacuum filtration method and a pressure filtration method. No particular limitation is also imposed on a drying method, and various methods may be used.

The volume average particle diameter Dv of the toner particles is preferably 3 to 15 μm, more preferably 4 to 12 μm. If the Dv is too small, the flowability of the resulting toner is lowered, and so its transferability may be lowered, blur may occur, or an image density may be lowered in some cases. If the Dv is too great, the resolution of an image formed with such a toner may be deteriorated in some cases.

In the present invention, the toner particles require satisfying a shape factor SF-1 of 115 to 150 and a shape factor SF-2 of 110 to 140. The shape factor SF-1 is preferably 115 to 130, more preferably 118 to 128. The shape factor SF-2 is preferably 120 to 135, more preferably 123 to 133. A ratio (SF-2/SF-1) of the shape factor SF-2 to the shape factor SF-1 is preferably 1.00 to 1.10, more preferably 1.00 to 1.05. When the toner particles satisfy the required properties as to the shape factor, high transferability and cleaning ability can be reconciled.

The shape factors SF-1 and SF-2 are values defined by the following respective equations.

$$(\text{SF-1})=(L\text{MAX}^2/S)\times(\pi/4)\times 100$$

$$(\text{SF-2})=(R^2/S)\times(1/4\pi)\times 100$$

wherein LMAX is the absolute greatest length of a projected image, S is a projected area of the projected image, and R is a peripheral length of the projected image.

The shape factor SF-1 indicates the degree of distortion in the whole particle, and the shape factor SF-2 indicates the degree of irregularities in a partial fine portion of a particle.

In the present invention, the toner particles and the external additive, and optionally other particles may be mixed by means of a high-speed stirrer such as a Henschel mixer for the purpose of adjusting the charge property, flowability, shelf stability and the like of the resulting toner to provide a one-component toner (one-component developer). Carrier particles such as ferrite or iron powder may also be further mixed in addition to the toner particles and the external additive, and optionally other particles by various publicly known methods to provide a two-component toner (two-component developer). Since the effects of the present invention are more developed when the technique of the present invention is applied, a nonmagnetic toner is preferably provided, and a nonmagnetic one-component toner (nonmagnetic one-component developer) is more preferably provided.

(10) External Additive

The external additive used in the present invention contains positively charged inorganic particles subjected to a hydrophobization treatment with an amino group-containing compound on the surfaces thereof.

The external additive is used for the purpose of improving flowability and charge property. Examples of fine particles used as the external additive include inorganic particles such as silica, aluminum oxide, titanium dioxide, zinc oxide, tin oxide, calcium carbonate, calcium phosphate and cerium oxide; and organic resin particles such as particles of methacrylic ester polymers, acrylic ester polymers, styrene-methacrylic ester copolymers, styrene-acrylic ester copolymers and melamine resins, and core-shell type particles in which the core is formed by a styrene polymer, and the shell is formed by a methacrylic ester polymer.

Among these, silica and titanium dioxide are suitable for use. Fine particles obtained by subjecting the surfaces of these particles to a hydrophobization treatment are preferred, and fine silica particles subjected to the hydrophobization treatment are more preferred. It is preferable to use two or more kinds of fine silica particles subjected to the hydrophobization treatment in combination.

The amount of the external additive added is preferably 0.1 to 10 parts by weight, more preferably 1 to 6 parts by weight per 100 parts by weight of the toner particles.

In the present invention, it is desirable to use, as the external additive, an external additive having a small particle diameter of preferably 5 to 25 nm, more preferably 7 to 15 nm in terms of a number average primary particle diameter. The external additive having a small particle diameter is preferably fine silica particles. When the number average primary particle diameter falls within this range, a toner having high flowability is obtained, and its transferability is improved. The external additive having a small particle diameter is subjected to the hydrophobization treatment with an amino group-containing agent among hydrophobizating agents. However, any amino group-free agent may also be used in combination.

Examples of the hydrophobizating agent include di-silazanes such as hexamethyldisilazane; cyclic silazanes; alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl)aminopropyltrimethoxysilane, γ-(2-aminoethyl)aminopropylmethyldimethoxysilane, aminosilane, N-(2-aminoethyl)-3-aminopropyltrimethoxysilane and N-β-(N-vinylbenzylaminoethyl)-γ-aminopropyltrimethoxysilane.

Examples of silicone oil include dimethyl polysiloxane, methyl hydrogenpolysiloxane, methylphenyl polysiloxane and amino-modified silicone oil.

An aminosilane compound is more preferably used as the amino group-containing hydrophobizating agent because a good positively charged toner is easily obtained.

The amount of the external additive having a small particle diameter to be added is preferably 0.1 to 2 parts by weight, more preferably 0.5 to 1.5 parts by weight per 100 parts by weight of the toner particles.

In the present invention, an external additive having a large particle diameter of, preferably 30 to 300 nm, more preferably 35 to 150 nm in terms of a number average primary particle diameter may be used. The external additive having a large particle diameter is preferably fine silica particles. When the number average primary particle diameter falls within this range, a toner having excellent cleaning ability is obtained. The external additive having a large particle diameter is preferably subjected to a hydrophobization treatment with an amino group-containing compound.

The amount of the external additive having a large particle diameter to be added is preferably 0.1 to 3 parts by weight, more preferably 0.5 to 2 parts by weight per 100 parts by weight of the toner particles. The external additive having a large particle diameter is preferably used in combination with the external additive having a small particle diameter from the viewpoint of highly adjusting a balance among various properties.

In the present invention, conductive inorganic fine particles may be used as an external additive. The conductive inorganic fine particles have a specific resistance of 500 Ω·cm or lower, preferably 0.1 to 300 Ω·cm, more preferably 1 to 200 Ω·cm. The addition of the conductive inorganic fine particles is preferred because the charge property of the resulting toner is stabilized.

Examples of the conductive inorganic fine particles include fine tin oxide particles, fine titanium oxide particle surface-treated with tin oxide, fine titanium oxide particle surface-treated with tin oxide doped with antimony (for example, trade names EC-100, EC-210 and EC-300, products of Titan Kogyo K.K.), fine titanium oxide particle surface-treated with indium oxide doped with antimony (for example, trade names EC-500 and EC-510, products of Titan Kogyo K.K.), fine aluminum oxide particle surface-treated with indium oxide doped with antimony (for example, trade name EC-700, product of Titan Kogyo K.K.), fine silicon oxide particle surface-treated with tin oxide doped with antimony (for example, trade name ES-650, product of Titan Kogyo K.K.), fine tin-antimony composite oxide particles (for example, trade name EC-900, product of Titan Kogyo K.K.; and trade name T-1, product of Jemco Co.), and fine indium-tin composite oxide particles (for example, trade name ITO, product of Jemco Co.).

The conductive inorganic fine particles are preferably subjected to a hydrophobization treatment, more preferably subjected to a hydrophobization treatment with an amino group-containing compound.

The BET specific surface area of the conductive inorganic fine particles is preferably 10 to 100 $m^2/g$. The BET specific surface area of the external additive is measured by the BET method according to ASTM D 3037-81.

The number average primary particle diameter of the conductive inorganic fine particles is preferably 30 to 300 nm, more preferably 35 to 150 nm.

The amount of the conductive inorganic fine particles added is 0.05 to 2 parts by weight, preferably 0.1 to 1 part by weight per 100 parts by weight of the toner particles. When the conductive inorganic fine particles are added, the effect brought about by the addition is not achieved if the amount added is too small, while such fine particles are liable to be liberated from the toner particles if the amount added is too great.

The conductive inorganic fine particles are preferably used together with the external additive having a small particle diameter, or together with the external additive having a small particle diameter and the external additive having a large particle diameter.

In the present invention, a general method may be used as a method for subjecting the inorganic fine particles such as fine silica particle and fine titanium dioxide particles to the hydrophobization treatment, and dry methods and wet methods may be mentioned. Specific examples thereof include a method in which a hydrophobizating agent is added dropwise or sprayed while stirring fine silica particles at high speed; and a method in which the inorganic fine particles are added into a solution with a hydrophobizating agent dissolved in an organic solvent while stirring the solution. In the case of the former method, the hydrophobizating agent may be diluted with an organic solvent before use.

The stirring of the external additive may be conducted by means of HENSCHEL MIXER (trade name, manufactured by MITSUI MINING COMPANY, LIMITED), SUPER-MIXER (trade name, manufactured by KAWATA MFG Co., Ltd.), Q MIXER (trade name, manufactured by MITSUI MINING COMPANY, LIMITED), MECHANOFUSION SYSTEM (trade name, manufactured by Hosokawa Micron Corporation), MECHANOMILL (trade name, manufactured by OKADA SEIKO CO., LTD.), or the like.

EFFECTS OF THE INVENTION

According to the present invention, there can be provided a positively charged developer for development of electrostatic images, by which good cleaning ability is retained, and printing properties are not impaired even when printing is conducted on a large number of sheets, and a production process thereof.

In particular, according to the present invention, there can be provided a positively charged developer for development of electrostatic images, which is hard to cause fog even upon printing under a high-temperature and high-humidity environment and exhibits excellent environmental stability in addition to the good cleaning ability, and a production process thereof.

EXAMPLES

The present invention will hereinafter be described in more detail by the following Examples and Comparative Examples. However, the present invention is not limited to the following examples alone. All designations of "part" or "parts" and "%" mean part or parts by weight and % by weight unless expressly noted.

Testing methods conducted in the following examples are as follows.

(1) Particle Diameter

The volume average particle diameter Dv, number average particle diameter Dp and particle diameter distribution Dv/Dp of each toner were measured by means of a particle diameter measuring device (manufactured by Beckman Coulter Co.; trade name "MULTISIZER"). The measurement by this particle diameter measuring device was conducted under the following conditions:

Aperture diameter: 100 μm;

Medium: ISOTON II; and

Number of particles measured: 100,000 particles.

Specifically, 0.1 g of a toner sample was placed in a beaker, and an aqueous solution of alkylbenzenesulfonic acid (product of Fuji Photo Film Co., Ltd.; trade name: DRYWELL) as a dispersant was added into the beaker. After 2 ml of ISOTON II was added to the beaker to wet the toner, 10 ml of ISOTON II was additionally added. The resultant mixture was subjected to a dispersing treatment for 1 minute by means of an ultrasonic dispersing device, followed by the measurement by the particle diameter measuring device.

(2) Shape Factors SF-1 and SF-2 of Toner

A toner was photographed by means of a field emission type scanning microscope (manufactured by Hitachi Ltd.; trade name: S-800), 100 toner particles were sampled at random from the photograph. With respect to the 100 toner particles sampled, the image information thereof was analyzed by an image analyzer (manufactured by NIRECO Corporation, trade name: LUZEX 3) to obtain values of Shape factors SF-1 and SF-2.

(3) Environmental Stability [Initial Fog (HH Environment)]

After a toner was charged into a commercially available printer of a nonmagnetic one-component development system and left to stand for a day under a high-temperature and high-humidity (HH) environment of 32.5° C. in temperature and 80% in humidity, fog was measured in the following manner.

White solid printing (image density: 0%) was conducted by the printer, and the printer was stopped in the middle of the white solid printing. A toner remaining in a non-image area on a photosensitive member after development was peeled off with an unused pressure-sensitive adhesive tape (product of Sumitomo 3M Limited, trade name: SCOTCH MENDING TAPE 810-3-18). This pressure-sensitive adhesive tape was stuck on new paper for printing to measure a color tone at a portion applied with the toner on the paper for printing by means of a spectroscopic color-difference meter (manufactured by Nippon Denshoku K.K., trade name: SE-2000). An unused pressure-sensitive adhesive tape was stuck as a reference on new paper for printing to measure a color tone likewise. Their color tones were represented as coordinates of the L*a*b* color space to calculate out a color difference ΔE from the color tones of the measured sample and reference sample to find a fog value (%). The smaller fog value indicates a toner providing an image that fog is less, and image quality is better.

(4) Durability Test Upon Printing

1. Durability Upon Printing [Paper Sheets Printed Up to Occurrence of Fog (NN Environment)]

A toner was charged into a commercially available printer of a nonmagnetic one-component development system and left to stand for a day under a normal-temperature and normal-humidity (NN) environment of 23° C. in temperature and 50% in humidity, continuous printing was conducted under the same NN environment at an image density of 1%. This continuous printing test is referred to as a durability test upon printing.

The durability test upon printing was conducted up to occurrence of fog or cleaning failure. When neither fog nor cleaning failure occurred, the continuous printing was conducted up to 15,000 sheets of paper.

After printing was conducted on every 1,000 sheets of paper, a fog value was measured by the measuring method described in the item (3). When the fog value reached 1.0% or higher, the number of paper sheets printed up to that time was regarded as the number of paper sheets printed up to occurrence of fog.

2. Cleaning Ability (Paper Sheets Printed Up to Occurrence of Cleaning Failure)

The cleaning ability was evaluated by visually observing a photosensitive member and a charging roll after completion of printing on every 500 sheets of paper to determine whether stripes (filming) due to cleaning failure occurred or not. The cleaning ability was ranked by the number of paper sheets printed up to occurrence of cleaning failure.

The test results as to the durability test upon printing were indicated as the number of paper sheets printed up to occurrence of fog and the number of paper sheets printed up to occurrence of cleaning failure. In the results as to the durability test upon printing, for example, when the number of paper sheets printed up to occurrence of cleaning failure is indicated as ">14,000", it indicates that no cleaning failure occurred even when printing was continuously conducted on 14,000 sheets of paper, and "14,000" indicates that cleaning failure occurred at the time printing had been continuously conducted on 14,000 sheets of paper.

Preparation Example of Charge Control Resin A

A monomer mixture composed of 86.5 parts of styrene, 11.5 parts of butyl acrylate and 2 parts of N,N-diethyl-N-methyl-2-(methacryloyloxy)ethylammonium p-toluene-sulfonate (monomer forming a repeating unit having a structure of $R^1$=methyl group, $R^2$=ethylene group, $R^3$ and $R^4$=ethyl groups, and $R^5$=methyl group in the structural formula (1)), and 2 parts of azobisisobutyronitrile were placed in a flask containing 70 parts of methyl ethyl ketone as a solvent. While stirring a solution within the flask, solution polymerization was conducted for 10 hours at 80° C. under introduction of nitrogen. Thereafter, methyl ethyl ketone was distilled off to obtain a charge control resin A (weight-average molecular weight=20,000, Tg=75° C.).

Example 1

After a dispersion of resin particles for core and a dispersion of fine charge control resin particles, which will become a shell layer, were respectively prepared, both dispersions were mixed to aggregate and fusion-bond the resin particles for shell layer on each surface of colored resin particles, which will become core particles, thereby preparing positively charged toner particles.

1. Preparation Step of Dispersion of Resin Particles for core (1) Preparation of Fine Binder Resin Particles Forming Core After 48.2 parts of styrene, 15.3 parts of n-butyl acrylate and 6.4 parts of methacrylic acid as polymerizable monomers were mixed in a flask and heated to 80° C., 26.8 parts of dipentaerythritol hexamyristate as a parting agent was added and dissolved to prepare a monomer composition.

On the other hand, 0.7 parts of sodium dodecylbenzenesulfonate as an anionic surfactant was dissolved in 373 parts of ion-exchanged water in a separable flask to prepare a surfactant solution.

After the surfactant solution was heated to 80° C., the monomer composition was added and dispersed by an emulsifying and dispersing machine (manufactured by M TECHNIQUE CO., LTD., trade name: CLEARMIX) to prepare an emulsified dispersion of the monomer composition.

After 400 parts of ion-exchanged water was added to the emulsified dispersion, an aqueous solution (aqueous solution with 2.1 parts of potassium persulfate dissolved in 39.6 parts of ion-exchanged water) containing 2.1 parts of potassium persulfate as a polymerization initiator and 1.9 parts of n-octylmercaptan as a molecular weight modifier were added to conduct polymerization (first-stage polymerization) under conditions of 80° C. and 3 hours.

After an aqueous solution (aqueous solution with 3.2 parts of potassium persulfate dissolved in 61.3 parts of ion-exchanged water) of 3.2 parts of potassium persulfate as a polymerization initiator was additionally added, 81.1 parts of styrene, 12.0 parts of methacrylic acid and 36.8 parts of n-butyl acrylate as polymerizable monomers, and 2.1 parts of n-octylmercaptan as a molecular weight modifier were added dropwise. After the drop addition, the contents were kept for 2 hours at that temperature to conduct polymerization (second-stage polymerization). After the polymerization, the reaction mixture was cooled with water to obtain a dispersion of fine binder resin particles for core.

(2) Preparation of Colorant Dispersion

Twenty one parts of sodium dodecylbenzenesulfonate as an anionic surfactant was dissolved in 570 parts of ion-exchanged water under stirring. While stirring this solution, 100 parts of copper phthalocyanine (product of Dainippon Ink & Chemicals, Incorporated, trade name: CTBX 121) as a cyan colorant was gradually added and then subjected to a dispersion treatment by means of an emulsifying and dispersing machine (manufactured by M TECHNIQUE CO., LTD., trade name: CLEARMIX) to prepare a colorant dispersion.

(3) Aggregation and Fusion Bonding Step for Forming Resin Particles for Core

In a flask were placed 150 parts (in terms of solid content) of the dispersion of the fine binder resin particles for core, 645 parts of ion-exchanged water and 137 parts of the colorant dispersion, and the contents were stirred. After the temperature of the resultant dispersion was controlled to 30° C., a 5 mol/liter aqueous solution of sodium hydroxide was added until the pH of the dispersion reached 10.

An aqueous solution with 32 parts of magnesium chloride hexahydrate dissolved in 32 parts of ion-exchanged water was then added to the dispersion over 10 minutes at 30° C. under stirring. Thereafter, this dispersion was heated up to 90° C. for 60 minutes to conduct aggregation by salting out between the fine binder resin particles and the fine colorant particles and fusion bonding by heating.

While continuing the stirring and heating, the particle diameter of the resin particles for core was measured by a particle diameter measuring device (manufactured by Beckman Coulter Co.; trade name: MULTISIZER), and an aqueous solution with 8.8 parts of sodium chloride dissolved in 57.7 parts of ion-exchanged water was added at the time the volume average particle diameter reached 5.5 μm to stop the salting out and fusion bonding. The heating and stirring were continued for 3 hours at 90° C. to control the shape of the particles, thereby obtaining a dispersion of resin particles for core.

2. Forming Step of Shell Layer (1) Preparation Step of Dispersion of Fine Charge Control Resin Particles to Become Shell Layer While heating 100 parts of ethyl acetate to 80° C. and stirring it, 100 parts of the charge control resin A was added and dissolved to prepare an ethyl acetate solution of the charge control resin A.

On the other hand, after 2.36 parts of a nonionic surfactant (product of Sanyo Chemical Industries, Ltd., trade name: NAROACTY N200) was dissolved in 1,000 parts of ion-exchanged water in a separable flask, the resultant solution was heated to 80° C. while stirring it under a nitrogen atmosphere, thereby preparing a surfactant solution.

After the ethyl acetate solution of the charge control resin A was added while stirring the surfactant solution, and subjected to a dispersing treatment by means of an emulsifying and dispersing machine (manufactured by M TECHNIQUE CO., LTD., trade name: CLEARMIX), ethyl acetate was distilled off to obtain a dispersion of the fine charge control resin particles (fine resin particles for shell).

(2) Step of Forming Shell by Aggregation and Fusion Bonding of Fine Charge Control Resin Particles After a 5 mol/liter aqueous solution of sodium hydroxide was added to 50.5 parts (in terms of solid content) of the dispersion of the fine resin particles for shell until the pH of the dispersion reached 8, this dispersion was added to the dispersion of the resin particles for core. The fine resin particles for shell were then aggregated and fusion-bonded on each surface of the resin particles for core to form a shell layer.

Thereafter, an aqueous solution with 71.5 parts of sodium chloride dissolved in 288 parts of ion-exchanged water was added to weaken cohesive force of the fine resin particles for shell, and heating and stirring were continued for additionally 2 hours at 95° C. Thereafter, the reaction mixture was cooled down to 25° C. and adjusted to pH 2 with hydrochloric acid to obtain a dispersion of positively charged toner particles.

3. Washing and Drying Step

The dispersion of the positively charged toner particles was dehydrated and sprayed with ion-exchanged water to conduct water washing, and then dried for a day at 50° C. under a pressure of 30 torr by means of a vacuum dryer to obtain positively charged toner particles. The volume average particle diameter (Dv) of the positively charged toner particles was 6.1 μm, and Dv/Dp was 1.19.

4. Step of Adding External Additive

Into 100 parts of the positively charged toner particles thus obtained, were added, as external additives, 1.0 part of positively charged fine silica particles (product of Cabot Co., trade name: TG820F, number average primary particle diameter: 11 nm; external additive having a small particle diameter) subjected to a hydrophobization treatment with an amino group-containing compound and 1.5 parts of positively charged fine silica particles (product of Aerosil Co., trade name: NA50Y, number average primary particle diameter: 40 nm; external additive having a large particle diameter) subjected to a hydrophobization treatment with an amino group-containing compound, and these components were mixed for 25 minutes by means of a high-speed stirrer (manufactured by MITSUI MINING COMPANY, LIMITED, trade name: HENSCHEL MIXER), the peripheral speed of a rotating blade of which was preset to 30 m/sec. Thereafter, coarse particles were removed by a sieve having a mesh size of 45 μm to prepare a positively charged toner. The test results are shown in Table 1.

Example 2

A positively charged toner was prepared in the same manner as in Example 1 except that 1.0 part of positively charged fine silica particles (product of Cabot Co., trade name: TG820F, number average primary particle diameter: 11 nm; external additive having a small particle diameter) subjected to a hydrophobization treatment with an amino group-containing compound, 1.5 parts of positively charged fine silica particles (product of Aerosil Co., trade name: NA50Y, number average primary particle diameter: 40 nm; external additive having a large particle diameter) subjected to a hydrophobization treatment with an amino group-containing compound, and 0.2 parts of particles obtained by subjecting fine titanium dioxide particles (product of Titan Kogyo K.K., trade name: EC-300, number average primary particle diameter: 65 nm; conductive inorganic fine particles) subjected to a hydrophobization treatment with an amino group-containing compound were added as external additives. The test results are shown in Table 1.

Example 3

A positively charged toner was prepared in the same manner as in Example 1 except that 0.8 parts of positively charged fine silica particles (product of Clariant Co., trade name: HDK2150, number average primary particle diameter: 12 nm; external additive having a small particle diameter) subjected to a hydrophobization treatment with an amino group-containing compound, and 1.0 part of positively charged fine silica particles (product of Aerosil Co., trade name: NA50Y, number average primary particle diameter: 40 nm; external additive having a large particle diameter) subjected to a hydrophobization treatment with an amino group-containing compound were added as external additives. The test results are shown in Table 1.

Example 4

A positively charged toner was prepared in the same manner as in Example 1 except that 1.2 parts of positively charged fine silica particles (product of Cabot Co., trade name: TG820F, number average primary particle diameter: 11 nm; external additive having a small particle diameter) subjected to a hydrophobization treatment with an amino group-containing compound were added as an external additive. The test results are shown in Table 1.

Comparative Example 1

A positively charged toner was prepared in the same manner as in Example 1 except that 0.8 parts of negatively charged fine silica particles (product of Nippon Aerosil Co., Ltd., trade name: R805, number average primary particle diameter: 21 nm; external additive having a small particle diameter) subjected to a hydrophobization treatment with octylsilane were added as an external additive. The test results are shown in Table 1.

Comparative Example 2

A positively charged toner was prepared in the same manner as in Example 1 except that 1.0 part of negatively charged fine silica particles (product of Nippon Aerosil Co., Ltd., trade name: R202, number average primary particle diameter: 14 nm; external additive having a small particle diameter) subjected to a hydrophobization treatment with dimethyl polysiloxane were added as an external additive. The test results are shown in Table 1.

Comparative Example 3

A polymerizable monomer (calculated Tg of the resulting copolymer=60° C.) composed of 83 parts of styrene and 17 parts of butyl acrylate, 5 parts of copper phthalocyanine (product of Dainippon Ink & Chemicals, Incorporated, trade name: CTBX 121) as a cyan colorant, 1 part of the charge control resin A, 0.9 parts of divinylbenzene, 1.9 parts of t-dodecylmercaptan as a molecular weight modifier, and 0.25 parts of a polymethacrylic ester macromonomer (product of Toagosei Chemical Industry Co., Ltd., trade name: AA6; Tg: 94° C.) were stirred and mixed in a stirring device and then uniformly dispersed by a media type dispersing machine. Five parts of dipentaerythritol hexamyristate was added to and mixed with the resultant dispersion and dissolved therein, thereby obtaining a polymerizable monomer composition.

On the other hand, an aqueous solution with 4.8 parts of sodium hydroxide dissolved in 50 parts of ion-exchanged water was gradually added to an aqueous solution with 8.6 parts of magnesium chloride dissolved in 250 parts of ion-exchanged water under stirring to prepare a colloidal dispersion of magnesium hydroxide.

The polymerizable monomer composition was poured into the colloidal dispersion of magnesium hydroxide at room temperature, the mixture was stirred until droplets became stable, and 5 parts of t-butyl peroxy-2-ethylhexanoate (product of Nippon Oil & Fats Co., Ltd., trade name: PERBUTYL 0) as a polymerization initiator was added to the mixture. The resultant mixture was then stirred under high shearing for 10 minutes at a rotating speed of 15,000 rpm by means of an in-line type emulsifying and dispersing machine (manufactured by Ebara Corporation, trade name: Ebara Milder) to form droplets of the polymerizable monomer composition.

The resultant dispersion was then heated to 90° C. to conduct a polymerization reaction. After completion of the polymerization reaction, the reaction mixture was cooled with water to stop the reaction, thereby obtaining an aqueous dispersion having a pH of 9.5.

While stirring the above-obtained aqueous dispersion, sulfuric acid was added until the pH of the dispersion reached 4 or lower, thereby dissolving the magnesium hydroxide colloid. After water was separated by filtration, 500 parts of ion-exchanged water was newly added to form a slurry again. Thereafter, the dehydration and water washing were conducted repeatedly several times, and solids were then separated by filtration. The solids were then placed in a vacuum dryer and dried at 45° C. for a day under a pressure of 3 kPa to obtain positively charged toner particles. The volume average particle diameter (Dv) of the positively charged toner particles was 6.0 μm, and Dv/Dp was 1.21.

Into 100 parts of the positively charged toner particles thus obtained, were added 1.0 part of negatively charged fine silica particles (product of Nippon Aerosil Co., Ltd., trade name: R202, number average primary particle diameter: 14 nm; external additive having a small particle diameter) subjected to a hydrophobization treatment with dimethyl polysiloxane, and these components were mixed by means of a high-speed stirrer (manufactured by MITSUI MINING COMPANY, LIMITED, trade name: HENSCHEL MIXER) to prepare a non-magnetic one-component positively charged toner. The test results are shown in Table 1.

TABLE 1

| | Example | | | | Comparative Example | | |
|---|---|---|---|---|---|---|---|
| | 1 | 2 | 3 | 4 | 1 | 2 | 3 |
| Positively charged toner particles | | | | | | | |
| Shape factor SF-1 | 123 | 123 | 123 | 123 | 123 | 123 | 108 |
| Shape factor SF-2 | 126 | 126 | 126 | 126 | 126 | 126 | 119 |
| External additive (parts) | | | | | | | |
| Positively charged silica 1 (11 nm) | 1.0 | 1.0 | — | 1.2 | — | — | — |
| Positively charged silica 2 (12 nm) | — | — | 0.8 | — | — | — | — |
| Positively charged silica 3 (40 nm) | 1.5 | 1.5 | 1.0 | — | — | — | — |
| Negatively charged silica 1 (21 nm) | — | — | — | — | 0.8 | — | — |
| Negatively charged silica 2 (14 nm) | — | — | — | — | — | 1.0 | 1.0 |
| Conductive titanium dioxide (65 nm) | — | 0.2 | — | — | — | — | — |
| <Printing test> | | | | | | | |
| Initial fog (HH environment) | 1.2 | 0.6 | 0.8 | 1.1 | 8.1 | 11.5 | 1.2 |
| Number of paper sheets printed up to occurrence of fog (NN environment) | 14000 | 15000 | 12000 | >10000 | >6000 | >7000 | >500 |

TABLE 1-continued

| | Example | | | | Comparative Example | | |
|---|---|---|---|---|---|---|---|
| | 1 | 2 | 3 | 4 | 1 | 2 | 3 |
| Number of paper sheets printed up to occurrence of cleaning failure (NN environment) | >14000 | >15000 | >12000 | 10000 | 6000 | 7000 | 500 |

(Note)

(1) Positively charged silica 1: Positively charged fine silica particles subjected to a hydrophobization treatment with an amino group-containing compound; product of Cabot Co., trade name: TG820F, number average primary particle diameter: 11 nm.
(2) Positively charged silica 2: Positively charged fine silica particles subjected to a hydrophobization treatment with an amino group-containing compound; product of Clariant Co., trade name: HDK2150, number average primary particle diameter: 12 nm.
(3) Positively charged silica 3: Positively charged fine silica particles subjected to a hydrophobization treatment with an amino group-containing compound; product of Aerosil Co., trade name: NA50Y, number average primary particle diameter: 40 nm.
(4) Negatively charged silica 1: Negatively charged fine silica particles subjected to a hydrophobization treatment with octylsilane; product of Nippon Aerosil Co., Ltd., trade name: R805, number average primary particle diameter: 21 nm.
(5) Negatively charged silica 2: Negatively charged fine silica particles subjected to a hydrophobization treatment with dimethyl polysiloxane; product of Nippon Aerosil Co., Ltd., trade name: R202, number average primary particle diameter: 14 nm.
(5) Conductive titanium dioxide: Particles obtained by subjecting fine titanium dioxide particles (product of Titan Kogyo K.K., trade name: EC-300, number average primary particle diameter: 65 nm; conductive inorganic fine particles) subjected to a hydrophobization treatment with an amino group-containing compound.

<Consideration>

The following facts are known from the test results shown in Table 1.

In the positively charged toner of Comparative Example 1 using, as the external additive, the negatively charged fine silica particles subjected to the hydrophobization treatment with octylsilane, occurrence of fog was observed under the high-temperature and high-humidity (HH) environment, and cleaning failure occurred when the continuous printing was conducted on 6,000 sheets of paper though occurrence of fog was not observed even when the continuous printing was conducted on 6,000 sheets of paper under the normal-temperature and normal humidity (NN) environment.

In the positively charged toner of Comparative Example 2 using, as the external additive, the negatively charged fine silica particles subjected to the hydrophobization treatment with dimethyl polysiloxane, occurrence of fog was observed under the high-temperature and high-humidity (HH) environment, and cleaning failure occurred when the continuous printing was conducted on 7,000 sheets of paper though occurrence of fog was not observed even when the continuous printing was conducted on 7,000 sheets of paper under the normal-temperature and normal humidity (NN) environment.

In the positively charged toner of Comparative Example 3 using the same external additive as in Comparative Example 2 and having a shape factor outside the range defined in the present invention, occurrence of fog was not observed under the high-temperature and high-humidity (HH) environment, but cleaning failure occurred when the continuous printing was conducted on 500 sheets of paper though occurrence of fog was not observed even when the continuous printing was conducted on 500 sheets of paper under the normal-temperature and normal humidity (NN) environment, and so the toner was poor in cleaning ability.

On the other hand, the positively charged toners of Examples 1 to 4 according to the present invention causes no fog under the high-temperature and high-humidity (HH) environment and were good in both durability and cleaning ability in the durability test upon printing.

INDUSTRIAL APPLICABILITY

The positively charged developers for development of electrostatic images according to the present invention can be used as developers in image forming apparatus of the electrophotographic system, such as facsimiles, copying machines and printers.

The invention claimed is:

1. A positively charged developer for development of electrostatic images, comprising positively charged toner particles and an external additive, wherein (a) the positively charged toner particles are colored resin particles having a core-shell structure, wherein the colored resin particles having the core-shell structure are obtained by forming a shell formed of an aggregated and fusion-bonded layer of the fine charge control resin particles having positively charging ability on each surface of core particles composed of aggregated and fusion-bonded particles of the fine binder resin particles and the fine colorant particles obtained by an emulsion polymerization aggregation process, and wherein the fine binder resin particles are obtained by polymerizing a monovinyl monomer used as a main component of the polymerizable monomer, (b) the positively charged toner particles have a shape factor SF-1 of 115 to 150, a shape factor SF-2 of 110 to 140 and a ratio (SF-2/SF-1) of 1.00 to 1.10, and (c) the external additive contains positively charged inorganic particles subjected to a hydrophobization treatment with an amino group-containing compound and having a small particle diameter of 5 to 25 nm in terms of a number average primary particle diameter and positively charged inorganic particles subjected to a hydrophobization treatment with an amino group-containing compound and having a large particle diameter of 30 to 300 nm in terms of a number average primary particle diameter, and (d) the charge control resin having positively charging ability is a polymer comprising a quaternary ammonium salt-containing acrylate unit represented by the following structural formula (I):

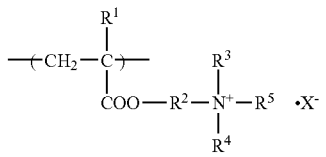

(1)

wherein $R^1$ is a hydrogen atom or a methyl group, $R^2$ is an alkylene group, $R^3$, $R^4$ and $R^5$ are, independently of one another, a hydrogen atom, a linear or branched alkyl group having 1 to 6 carbon atoms, or a cyclic alkyl group, and $X^-$ is an alkylbenzenesulfonic ion.

2. The positively charged developer for development of electrostatic images according to claim 1, wherein the inorganic particles having a small diameter are positively charged fine silica particles subjected to a hydrophobization treatment with an amino group-containing compound and having a number average primary particle diameter of 5 to 25 nm, and the inorganic particles having a large diameter are positively charged fine silica particles subjected to a hydrophobization treatment with an amino group-containing compound and having a number average primary particle diameter of 30 to 300 nm.

3. The positively charged developer for development of electrostatic images according to claim 1, wherein the external additive contains conductive fine particles subjected to a hydrophobization treatment with an amino group-containing compound and having a number average primary particle diameter of 30 to 300 nm in addition to the positively charged inorganic particles subjected to the hydrophobization treatment with the amino group-containing compound.

4. The positively charged developer for development of electrostatic images according to claim 3, wherein the conductive fine particles are fine titanium dioxide particles subjected to a hydrophobization treatment with an amino group-containing compound and having a number average primary particle diameter of 30 to 300 nm.

5. A process for producing a positively charged developer for development of electrostatic images, which comprises positively charged toner particles and an external additive, the process comprising:

(1) Step 1 of producing the positively charged toner particles composed of colored resin particles having a shape factor SF-1 of 115 to 150, a shape factor SF-2 of 110 to 140, a shape factor SF-2 of 110 to 140 and a ratio (SF-2/SF-1) of 1.00 to 1.10, including a step (i) of aggregating and fusion-bonding fine binder resin particles and fine colorant particles emulsified and dispersed in an aqueous medium, thereby producing aggregated and fusion-bonded particles and a step (ii) of adding fine particles of a charge control resin having positively charging ability emulsified and dispersed in an aqueous medium to aggregate and fusion-bond the fine particles of the charge control resin having positively charging ability on each surface of the aggregated and fusion-bonded particles so as to form a shell layer, thereby producing positively charged toner particles composed of colored resin particles of a core-shell structure, wherein the fine binder resin particles are obtained by polymerizing a monovinyl monomer used as a main component of the polymerizable monomer, wherein the charge control resin having positively charging ability is a polymer comprising a quaternary ammonium salt-containing acrylate unit represented by the following structural formula (1):

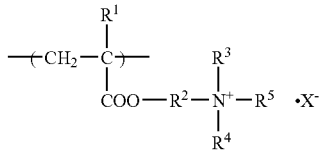

(1)

wherein $R^1$ is a hydrogen atom or a methyl group, $R^2$ is an alkylene group, $R^3$, $R^4$ and $R^5$ are, independently of one another, a hydrogen atom, a linear or branched alkyl group having 1 to 6 carbon atoms, or a cyclic alkyl group, and $X^-$ is an alkylbenzenesulfonic ion; and (2) Step 2 of externally adding positively charged inorganic particles subjected to a hydrophobization treatment with an amino group-containing compound to the colored resin particles, wherein the external additive contains positively charged inorganic particles subjected to a hydrophobization treatment with an amino group-containing compound and having a small particle diameter of 5 to 25 nm in terms of a number average primary particle diameter and positively charged inorganic particles subjected to a hydrophobization treatment with an amino group-containing compound and having a large particle diameter of 30 to 300 nm in terms of a number average primary particle diameter.

6. The production process according to claim 5, wherein the inorganic particles having a small diameter are positively charged fine silica particles subjected to a hydrophobization treatment with an amino group-containing compound and having a number average primary particle diameter of 5 to 25 nm, and the inorganic particles having a large diameter are positively charged fine silica particles subjected to a hydrophobization treatment with an amino group-containing compound and having a number average primary particle diameter of 30 to 300 nm.

7. The production process according to claim 5, wherein the external additive contains conductive fine particles subjected to a hydrophobization treatment with an amino group-containing compound and having a number average primary particle diameter of 30 to 300 nm in addition to the positively charged inorganic particles subjected to the hydrophobization treatment with the amino group-containing compound.

* * * * *